US008346153B2

(12) United States Patent
Ogawa

(10) Patent No.: US 8,346,153 B2
(45) Date of Patent: Jan. 1, 2013

(54) IMAGE FORMING APPARATUS

(75) Inventor: Daisuke Ogawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 619 days.

(21) Appl. No.: 12/411,936

(22) Filed: Mar. 26, 2009

(65) Prior Publication Data

US 2009/0269113 A1 Oct. 29, 2009

(30) Foreign Application Priority Data

Apr. 25, 2008 (JP) ..... 2008-116021

(51) Int. Cl.
*G03G 15/00* (2006.01)

(52) U.S. Cl. ..... 399/401; 399/111

(58) Field of Classification Search ..... 399/401, 399/410

See application file for complete search history.

(56) References Cited

U.S. PATENT DOCUMENTS

| | | | | |
|---|---|---|---|---|
| 5,337,134 | A | 8/1994 | Sato et al. | |
| 6,980,766 | B2 | 12/2005 | Ito | |
| 2006/0171760 | A1 * | 8/2006 | Deguchi | 400/642 |
| 2006/0228126 | A1 * | 10/2006 | Nihei | 399/82 |
| 2007/0003311 | A1 | 1/2007 | Sato | |
| 2007/0147921 | A1 * | 6/2007 | Chae | 399/401 |

FOREIGN PATENT DOCUMENTS

| | | |
|---|---|---|
| JP | 06-110274 | 4/1994 |
| JP | 06-175428 | 6/1994 |
| JP | 07-234559 | 9/1995 |
| JP | 09-030739 | 2/1997 |
| JP | 2001-171884 | 6/2001 |
| JP | 2002-104694 | 4/2002 |
| JP | 2002-258558 | 9/2002 |
| JP | 2003-026374 | 1/2003 |
| JP | 2004-294988 | 10/2004 |
| JP | 2005-088311 | 4/2005 |
| JP | 2007-010889 | 1/2007 |
| JP | 2007225829 A * | 9/2007 |
| JP | 2008037637 A * | 2/2008 |

OTHER PUBLICATIONS

Notification of Reasons for Refusal for corresponding Japanese Application 2008-116021 mailed on May 11, 2010.

* cited by examiner

*Primary Examiner* — Daniel J Colilla
*Assistant Examiner* — Allister Primo
(74) *Attorney, Agent, or Firm* — Banner & Witcoff, Ltd.

(57) ABSTRACT

An image forming apparatus includes an image forming unit including an image carrier carrying a developer image to form an image by transferring the developer image onto a recording sheet at an image forming position, a recording sheet accommodating unit, a feeding path, a conveyance roller provided in the feeding path for conveying the recording sheet to the image forming position, a discharge path that guides the recording sheet to an outside, a discharge roller being rotatable normally and reversely and discharging the recording sheet to the outside by rotating normally, and a reverse feeding path, by which the recording sheet is guided when the discharge roller reversely rotates, and which reverses the recording sheet so as to guide the recording sheet to be joined again with the feeding path. The reverse feeding path is joined with the feeding path between the image carrier and the conveyance roller.

18 Claims, 7 Drawing Sheets

IMAGE FORMING APPARATUS

CROSS-REFERENCE TO RELATED APPLICATIONS

This application claims priority from Japanese Patent Application No. 2008-116021 filed on Apr. 25, 2008, the entire subject matter of which is incorporated herein by reference.

TECHNICAL FIELD

Aspects of the invention relate to an image forming apparatus capable of forming images on both sides of a recording sheet.

BACKGROUND

There has been proposed a related art image forming apparatus capable of forming images on both sides of a sheet. For example, JP-A-2002-104694 (refer to FIG. 1, for example) discloses an example of the related art image forming apparatus, in which the sheet is first conveyed in a reverse feeding path by reverse turning of a discharge roller, passes through the reverse feeding path, and is conveyed again into a feeding path while reversing a conveyance direction of the sheet at a forward (i.e., upstream side in the conveyance direction of the sheet) of a registration roller provided immediately before a contacting position (i.e., an image forming position) of a photosensitive drum and a transfer roller. The sheet passes through the registration roller again and is conveyed to the image forming position.

SUMMARY

Illustrative aspects of the invention provide an image forming apparatus that is capable of reducing a size thereof and shortening a reverse feeding path.

DETAILED DESCRIPTION

General Overview

Figure 1:
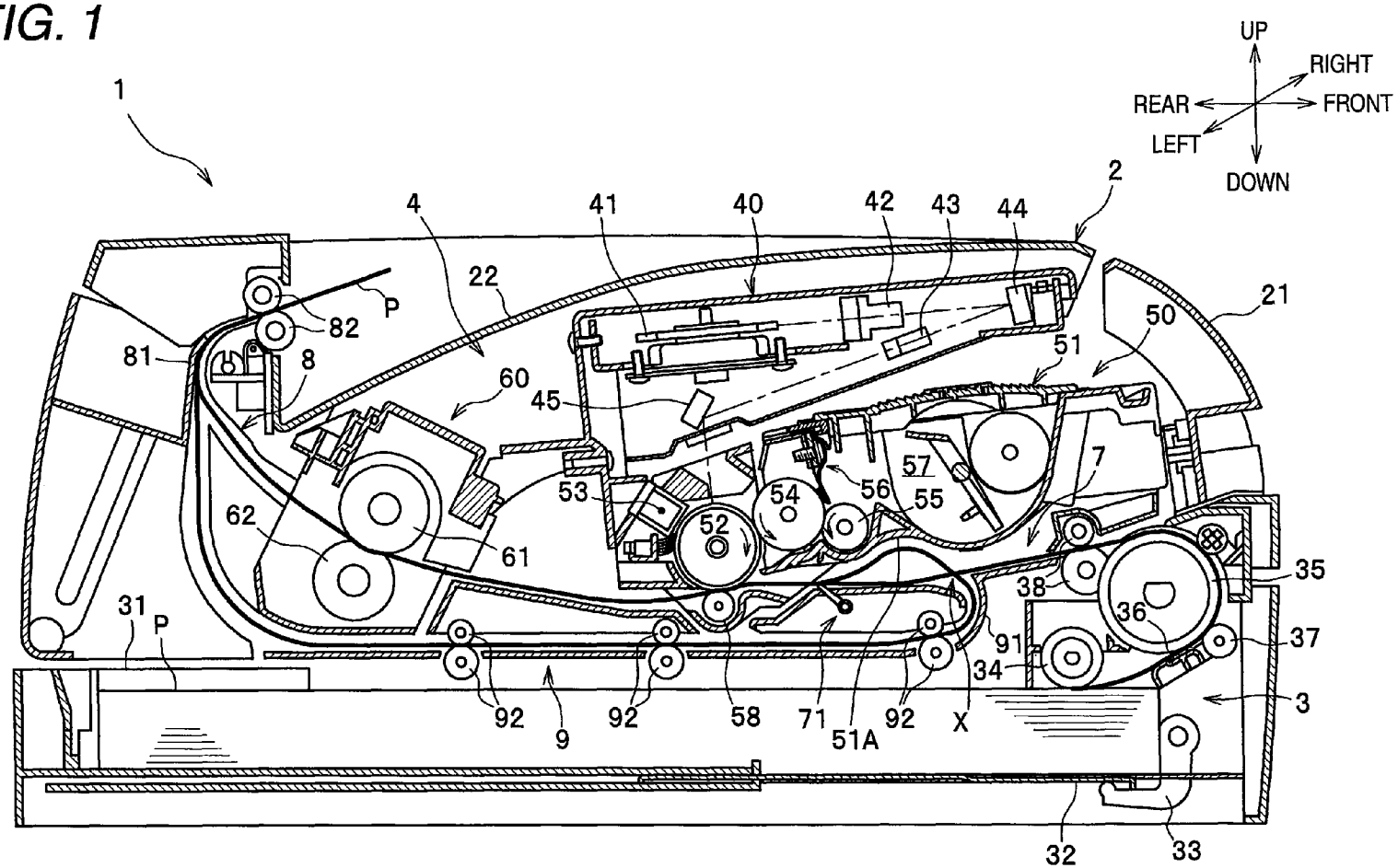
FIG. 1 is a sectional view showing an image forming apparatus according to a first exemplary embodiment of the invention.

The related art image forming apparatuses described above have some disadvantages. For example, since a feed roller, a feeding pad and a pickup roller etc., are provided forward of the registration roller, it is necessary to especially secure a space for a reverse feeding path where the reverse feeding path is provided at this portion. Thus, a size of the apparatus main body is increased, and a size of an entire apparatus becomes large. In addition, since the reverse feeding path is lengthened, a number of rollers for feeding the sheet are increased. Thus, occurrence frequency of paper jam may be increased.

Therefore, illustrative aspects of the invention provide an image forming apparatus that is capable of reducing a size thereof and shortening a reverse feeding path.

According to one aspect of the invention, there is provided an image forming apparatus that forms an image on both sides of a recording sheet, the image forming apparatus comprising: an apparatus main body; an image forming unit, which comprises an image carrier carrying a developer image, and which forms an image by transferring the developer image carried by the image carrier onto the recording sheet at an image forming position; a recording sheet accommodating unit, which is provided downward of the image forming unit, and which accommodates the recording sheet; a feeding path that guides the recording sheet conveyed from the recording sheet accommodating unit to the image forming position; a conveyance roller, which is provided in the feeding path, which regulates movement of leading end of the recording sheet, and which conveys the recording sheet to the image forming position; a discharge path that guides the recording sheet ejected from the image forming unit to an outside of the image forming apparatus; a discharge roller, which is provided in the discharge path, which is rotatable normally and reversely, and which discharges the recording sheet to the outside of the apparatus main body when the discharge roller normally rotates; and a reverse feeding path, by which the recording sheet is guided when the discharge roller reversely rotates, and which reverses the recording sheet so as to guide the recording sheet to be joined again with the feeding path, wherein the reverse feeding path is joined with the feeding path between the image carrier and the conveyance roller.

According thereto, the reverse feeding path is joined with the feeding path between the reverse feeding path and the conveyance roller (i.e., a registration roller) that regulates movement of the leading end of the recording sheet and conveys the recording sheet to the image forming position. Thus, it is not necessary to secure a space for the reverse feeding path at the upstream side of the registration roller. Therefore, the dimension of the apparatus main body can be made small, and the size of the apparatus can be reduced. Further, the reverse feeding path can be shortened in comparison with the related art image forming apparatus where the reverse feeding path is joined with the feeding path at the upstream side of the registration roller.

According to another aspect of the invention, there is provided an image forming apparatus that forms an image on both sides of a recording sheet, the image forming apparatus comprising: an apparatus main body; an image forming unit, which comprises an image carrier carrying a developer image, and which forms an image by transferring the developer image carried by the image carrier onto the recording sheet at an image forming position; a recording sheet accommodating unit, which is provided downward of the image forming unit, and which accommodates the recording sheet; a feeding path that guides the recording sheet conveyed from the recording sheet accommodating unit to the image forming position; a conveyance roller, which is provided in the feeding path at a position immediately before the image carrier, and which conveys the recording sheet to the image forming position; a discharge path that guides the recording sheet ejected from the image forming unit to an outside of the apparatus main body; a discharge roller, which is provided in the discharge path, which is rotatable normally and reversely, and which discharges the recording sheet to the outside of the apparatus main body when the discharge roller normally rotates; and a reverse feeding path, by which the recording sheet is guided when the discharge roller reversely rotates, and which reverses the recording sheet so as to guide the recording sheet to be joined again with the feeding path, wherein the reverse feeding path is joined with the feeding path between the conveyance roller and the image carrier.

According thereto, the reverse feeding path is joined with the feeding path between the image carrier and the conveyance roller immediately before the image carrier. Thus, it is not necessary to secure a space for the reverse feeding path at the upstream side of the conveyance roller immediately before the image carrier in the conveyance direction of the recording sheet. Therefore, the dimension of the apparatus main body can be made small, and the size of the apparatus can be reduced. Further, the reverse feeding path can be shortened in comparison with the related art image forming apparatus where the reverse feeding path is joined with the feeding path at the upstream side of the conveyance roller immediately before the image carrier in the conveyance direction of the recording sheet.

According to the image forming apparatus of the invention, the reverse feeding path is joined with the feeding path between the image carrier and the conveyance roller. Therefore, the size of the apparatus can be reduced, and the reverse feeding path can be shortened.

Exemplary Embodiments

Exemplary embodiments of the invention will now be described with reference to the drawings.

First Exemplary Embodiment

FIG. 1 is a sectional view of an image forming apparatus according to a first exemplary embodiment.

Herein, in the following description, the directions in the following description reference the arrows shown in FIG. 1 (the same is applied to other drawings). The vertical direction in the drawings is referred to as "up-down" direction.

(Image Forming Apparatus)

Referring to FIG. 1, an image forming apparatus 1 includes body casing 2 (one example of an apparatus main body), a feeder unit 3 and an image forming unit 4. The body casing 2 includes the feeder unit 3 and the image forming unit 4. The feeder unit 3 feeds a sheet P (one example of a recording sheet) The image forming unit 4 forms an image on the sheet P. The body casing 2 includes a feeding path 7 that guides sheets P from the feeder unit 3 to an image forming position (which will be described later), a discharge path 8 that guides the sheet P from the image forming unit 4 to the outside of the body casing 2, and a reverse feeding path 9 that guides the sheet P to the feeding path 7 again. Incidentally, a laser printer is one example of the image forming apparatus 1.

Figure 2:
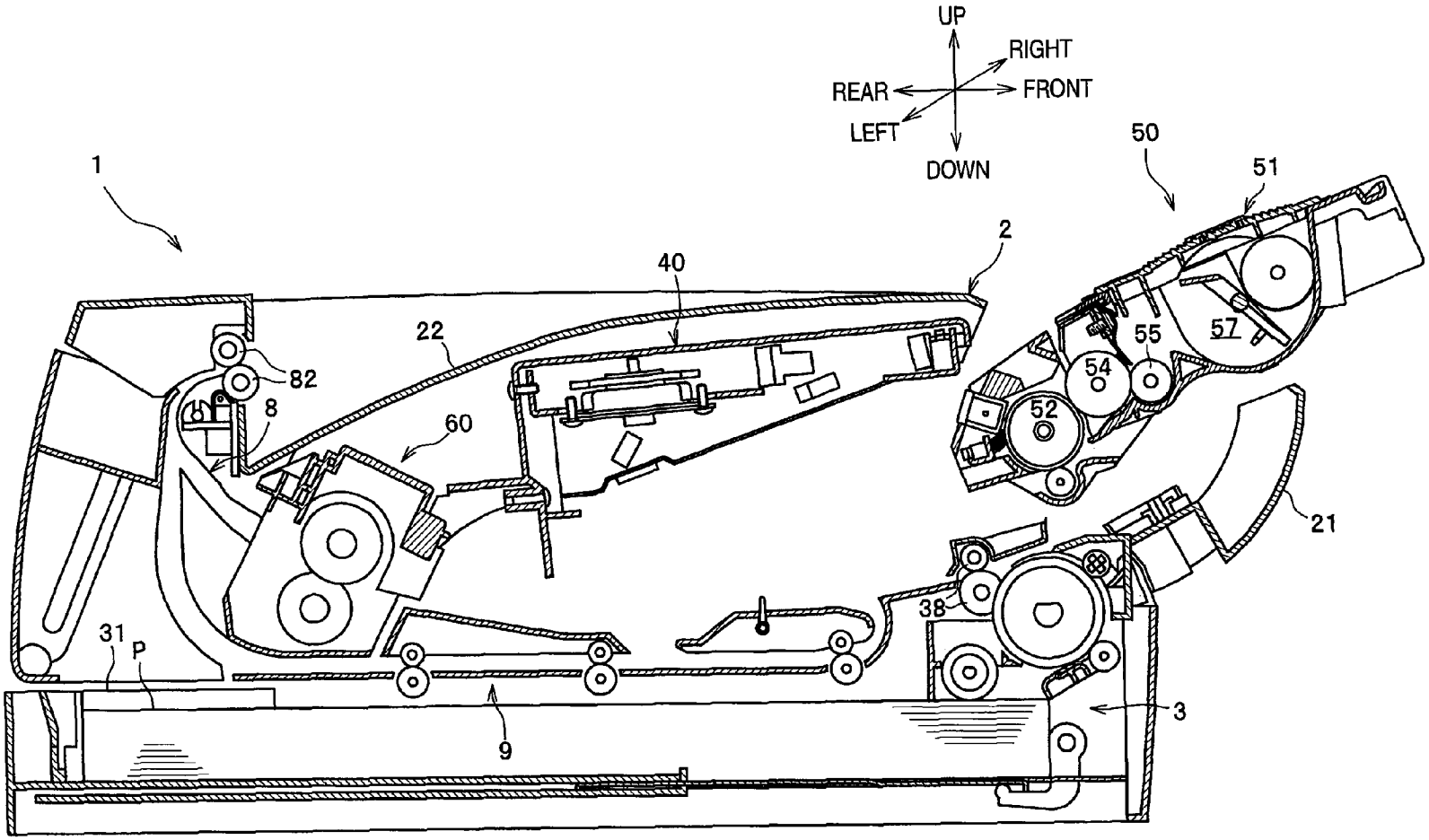
FIG. 2 is a sectional view of the image forming apparatus showing a state where a process cartridge is removed.

As shown in FIG. 2, a front cover 21, which is freely opened and closed, is provided at the front side of the body casing 2. A process cartridge 50 (which will be described later) can be removably mounted to the body casing 2 through an opening formed by opening the front cover 21. In addition, a sheet discharging tray 22 (one example of a recording sheet discharge unit), in which sheets P discharged outside the body casing 2 are stacked, is provided on an upper surface (i.e., upward of the image forming unit 4) of the body casing 2 (refer to FIG. 1).

(Feeder Unit)

As shown in FIG. 1, the feeder unit 3 includes a sheet feeding tray 31, a sheet pressing plate 32, a lift lever 33, a pickup roller 34, a feed roller 35, a feeding pad 36, a pinch roller 37 and a pair of registration rollers 38. The sheet feeding tray 31 (one example of a recording sheet accommodating unit) is removably mounted to a lower part (i.e., downward of the image forming unit 4) of the body casing 2 for accommodating sheets P. The sheet pressing plate 32 is swingably secured at the lower part of the sheet feeding tray 31 so as to lift forward end thereof. The lift lever 33 lifts up the sheet pressing plate 32 from a lower side thereof. The pickup roller 34 sends the sheet P from the sheet feeding tray 31 into the feeding path 7. The feed roller 35, the feeding pad 36 and the pinch roller 37 are provided at an upward of the front side of the sheet feeding tray 31. The pair of registration rollers 38 (one example of a conveyance roller) is provided rearward of the feed roller 35 so as to regulate movement of the leading end of the sheet P and to convey the sheet P to the image forming position.

(Image Forming Unit)

The image forming unit 4 includes an exposure unit 40, a process cartridge 50 for transferring a developer image onto the sheet P at the image forming position, and a fixture unit 60 for heating and fixing the developer image transferred on the sheet P.

(Exposure Unit)

The exposure unit 40 includes a laser light emitting portion (not illustrated) secured at the upper part in the body casing 2, a rotating polygon mirror 41, lenses 42 and 43, and reflection mirrors 44 and 45. The laser light emitting portion emits laser light based on image data. The emitted laser light is reflected or passed through the polygon mirror 41, lens 42, reflection mirror 44, lens 43 and reflection mirror 45 in order as shown by chain lines. The laser light is irradiated on the surface of a photosensitive drum 52 of the process cartridge 50 by high-speed scanning.

(Process Cartridge)

The process cartridge 50 is provided downward of the exposure unit 40, and is removably mounted to the body casing 2 (Refer to FIG. 2). In a hollow casing 51 that composes the outer frame, the process cartridge 50 includes a photosensitive drum 52 (one example of an image carrier), a charger 53, a developing roller 54 (one example of a developer carrier), a supply roller 55 (one example of a developer supply member), a layer thickness regulating blade 56, a developer accommodating unit 57 and a transfer roller 58.

The photosensitive drum 52, the developing roller 54, the supply roller 55 and the transfer roller 58 are rotatably supported in the casing 51. Also, the developer accommodating unit 57, the supply roller 55, the developing roller 54 and the photosensitive drum 52 are provided in order from the upstream side to the downstream side, that is, from forward to rearward, in the conveyance direction of the sheet P in the feeding path 7.

The photosensitive drum 52 has its cylindrical and conductive drum main body grounded, and a photosensitive layer having an electrostatic property is formed on the surface portion (the outer circumferential surface) of the drum main body.

The charger 53 includes a predetermined spacing to the photosensitive drum 52 and is opposed thereto so as not to be brought into contact with the photosensitive drum 52 rearward of the photosensitive drum 52, and the charger 53 is constructed so that the charger 53 can uniformly charge the surface of the photosensitive drum 52.

The developing roller 54 is provided so as to be brought into contact with the photosensitive drum 52 forward of the photosensitive drum 52, and is constructed so that developer is supplied to an electrostatic latent image formed on the photosensitive drum 52, in detail, on the surface of the photosensitive drum 52. Incidentally, positively charged, non-magnetic one component toner is one example of the developer.

The supply roller 55 supplies the developer to the developing roller 54, and is provided so as to be brought into contact with the developing roller 54 forward of the developing roller 54.

The layer thickness regulating blade 56 is brought into sliding contact with the developing roller 54 and regulates the thickness of the developer carried on the developing roller 54.

The developer accommodating unit 57 accommodates the developer supplied to the supply roller 55, and is formed forward of the supply roller 55. An agitator (with reference numeral and letter omitted) is provided in the developer accommodating unit 57.

The transfer roller 58 is provided at a position opposite to the photosensitive drum 52 so as to be brought into contact with the photosensitive drum 52 downward of the photosensitive drum 52. Transfer bias is applied to the transfer roller 58 by constant current control when transferring.

In the invention, the "image forming position" means a position where the photosensitive drum 52 and the transfer roller 58 are opposed and are brought into contact with each other. That is, the "image forming position" means a position where a developer image formed on the surface of the photosensitive drum 52 is transferred to sheet P.

The developer in the developer accommodating unit 57 is supplied to the supply roller 55 by rotations of the agitator. When the supply roller 55 and the developing roller 54 are rotated so as to be brought into sliding contact with each other, the developer is supplied onto the developing roller 54. The developer on the developing roller 54 enters between the layer thickness regulating blade 56 and the developing roller 54 by rotations of the developing roller 54, and is carried on the developing roller 54 as a thin layer having constant thickness.

(Fixing Unit)

The fixing unit 60 is provided rearward (i.e., at the downstream side in the conveyance direction of sheet P) of the process cartridge 50. The fixing unit 60 includes a heating roller 61 and a pressing roller 62. The pressing roller is opposed to and brought into contact with the heating roller 61 so as to nip the sheet P therebetween.

(Feeding Path)

The feeding path 7 guides the sheet P conveyed from the sheet feeding tray 31 of the feeder unit 3 to the image forming position. In detail, after the sheet P is sent out forward from the sheet feeding tray 31 by the pickup roller 34 and the conveyance direction of the sheet P is reversed from forward to rearward by the feed roller 35, the sheet P is guided to the image forming position while being conveyed directed downward and to the rear of the process cartridge 50.

The feeding path 7 includes the pickup roller 34, the feed roller 35, the feeding pad 36, the pinch roller 37 and the registration roller 38, which compose the feeder unit 3 described above, and a detection sensor 71 for detecting passage of the sheet P.

Figure 3:
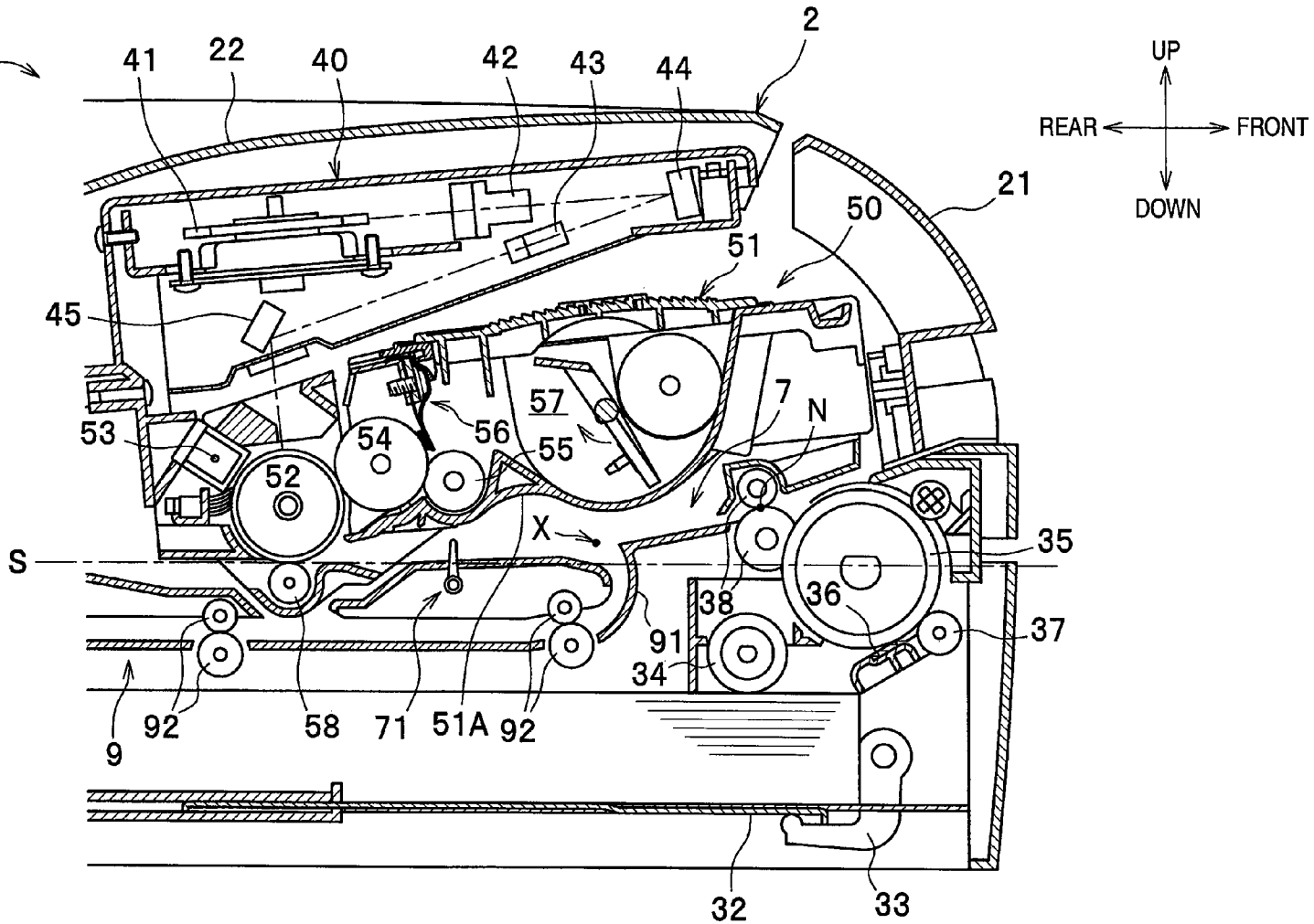
FIG. 3 is a partial enlarged view of the image forming apparatus around the process cartridge.

The registration rollers 38 include a pair of rollers secured at the upper part rearward of the feed roller 35 in the body casing 2. The registration rollers 38 convey the sheet P to the image forming position while correcting slewing of the sheet P by contacting with an end portion (i.e., a leading end in the conveyance direction) of the fed sheet P. As shown in FIG. 3, with respect to the registration roller 38, a nipping position N at which the sheet P is nipped is provided at a side where the photo sensitive drum 52 is provided beyond the extension face S in the conveyance direction of the sheet P at the image forming position, that is, upward thereof. The registration roller 38 and the pickup roller 34 are juxtaposed and provided so as to overlap each other in the up-down direction.

The detection sensor 71 detects passage of the sheet P. The detection sensor 71 is provided downward of the supply roller 55 between the photosensitive drum 52 and the registration roller 38. For example, when the detection sensor 71 detects passage (the leading end) of the sheet P when forming images, a control unit (not illustrated) controls light emission of the laser light emitting portion of the exposure unit 40 and rotation drive of the polygon mirror 41 so as to control an irradiation timing of the laser light from the exposure unit 40. That is, the detection sensor 71 has a function of determining the exposure timing on the surface of the photosensitive drum 52. In addition, when the detection sensor 71 continuously detects sheet P after the time for which sheet P completely passes elapses, it is determined by a control unit (not illustrated) that the sheet P is jammed in the feeding path. That is, the detection sensor 71 has a function of detecting an occurrence of paper jam.

(Discharge Path)

As shown in FIG. 1, the discharge path 8 guides the sheet P ejected from the image forming unit 4 to the outside of the body casing 2. In detail, the sheet P conveyed from the fixing unit 60 is guided rearward and diagonally upward, and the conveyance direction thereof is reversed from rearward to forward by a guide wall 81. Thus, the sheet P is guided to the sheet discharging tray 22.

A pair of discharge rollers 82 is provided in a vicinity of the outlet from the body casing 2 in the discharge path 8. The discharge rollers 82 can be controlled to be rotated in a normal direction, along which the nipped sheet P is conveyed to the outside of the body casing 2, and in a reverse direction, along which the nipped sheet P is conveyed into the reverse feeding path 9 (which will be described later). When an image is formed on both sides of the sheet P, the discharge roller 82 is reversely rotated to convey the sheet P to the reverse feeding path 9 before the sheet P is completely discharged to the outside of the body casing 2.

(Reverse Feeding Path)

In the reverse feeding path 9, the sheet P is guided by the reverse rotation of the discharge roller 82, and is guided so as to be joined with the feeding path 7 again by reversing the sheet P. In detail, the reverse feeding path 9 has a substantially U-shape so as to extend downward, forward and upward in order from a vicinity of the guide wall 81 of the discharge path 8. The reverse feeding path is joined with the feeding path 7 at a joining part X, passing downward of the image forming unit 4 and passing through a curved portion 91. A plurality of pairs of conveyance rollers 92, each of which conveys the sheet P, are provided in the reverse feeding path 9 with interposing appropriate intervals therebetween.

The curved portion 91 is formed downward of the joining part X of the reverse feeding path 9. The curved portion 91 guides the sheet P guided by the reverse feeding path 9 while bending the sheet P so as to reverse the conveyance direction of the sheet P from forward to rearward diagonally upward and to guide the sheet P to the feeding path 7.

As shown in FIG. 3, the joining part X is provided at the upstream side in the conveyance direction of sheet P in the feeding path 7 from the detection sensor 71 between the photosensitive drum 52 and the registration roller 38. That is, the joining part X is provided between the detection sensor 71 and the registration roller 38. In other words, the joining part X is provided at a position where the feeding path 7 is opposed to the process cartridge 50. That is, the joining part X is provided between the supply roller 55 and the developer accommodating unit 57 (i.e., near the developer accommodating unit 57) and downward of the process cartridge 50.

In the first exemplary embodiment, the process cartridge 50 includes a guide face 51A provided on a lower surface of the casing 51 between the supply roller 55 and the developer accommodating unit 57. The guide face 51A has an arc shape in a side view. The sheet P guided in the reverse feeding path 9 and ejected from the curved portion 91 is bent along the guide face 51A. Therefore, the conveyance direction of the sheet P is reversed from rearward diagonally upward to rearward diagonally downward, and the sheet P is again guided by the feeding path 7 toward the rearward (i.e., toward the image forming position).

(Image Forming Process)

Next, an image forming process of the image forming apparatus 1 will be described.

When the image forming process is executed, the sheet P in the sheet feeding tray 31 is lifted by the lift lever 33 and sheet pressing plate 32 and is drawn to the pickup roller 34 side, and is sent out to the feeding path 7 by means of the pickup roller 34 (see FIG. 1). The sheets P sent out by the sheet feeding tray 31 are separated one at a time by the feed roller 35 and the feeding pad 36. The conveyance direction of the sheet P is changed from forward to rearward, and the sheet P is conveyed toward the image forming position while the registration rollers 38 correcting the slewing of the sheet P.

When the leading end of sheet P conveyed toward the image forming position is detected by the detection sensor 71, laser light is irradiated from the exposure unit 40 toward the photosensitive drum 52, the surface of which has been uniformly charged by the charger 53, and the surface of the photosensitive drum 52 is exposed to light. Therefore, a potential of the position exposed to light is lowered, and an electrostatic latent image is formed on the photosensitive drum 52 based on the image data. The developer carried on the developing roller 54 is supplied to the electrostatic latent image formed on the photosensitive drum 52 when the developing roller 54 and the photosensitive drum 52 are brought into contact with each other. Therefore, the electrostatic latent image on the photosensitive drum 52 is visualized, and a developer image is formed.

Then, when the sheet P passes through the position where the photosensitive drum 52 carrying a developer image on the surface thereof and the transfer roller 58 are opposed to each other (i.e., when the sheet P passes through the image forming position), the developer image on the photosensitive drum 52 is transferred onto the sheet P. Then, the sheet P, on which the developer image transferred, enters the fixing unit 60. When the sheet P passes between the heating roller 61 and the pressing roller 62, the developer image is heated and fixed.

When the image is formed only on a single side of the sheet P, the sheet P conveyed from the fixing unit 60 is guided by the discharge path 8 to change the conveyance direction thereof from rearward to forward, and is discharged to the outside of the body casing 2 by the normally rotating discharge roller 82. The discharged sheet P is stacked in the sheet discharging tray 22.

In contrast, when images are formed on both sides of the sheet P, the sheet P conveyed from the fixing unit 60 is guided by the discharge path 8. When a large part of the sheet P is discharged to the outside of the body casing 2 by the normally rotating discharge roller 82, the discharge roller 82 is reversely rotated. The sheet P is then returned inside the body casing 2 and is guided to the reverse feeding path 9 along the guide wall 81.

The sheet P is conveyed forward in the reverse feeding path 9 by the conveyance roller 92, and the conveyance direction thereof is changed from forward to rearward along the curved portion 91 and the guide face 51A. The sheet P is again guided forward of the detection sensor 71 in the feeding path 7. At this time, the sheet P is reversed so that the side having the developer image formed is a lower side and the blank side is an upper side.

When the leading end of the sheet P is again detected by the detection sensor 71, the laser light is irradiated from the exposure unit 40 to the photosensitive drum 52, the surface of which has been uniformly charged by the charger 53, and the surface of the photosensitive drum 52 is exposed to light to form an electrostatic latent image. When the developing roller 54 and the photosensitive drum 52 are brought into contact with each other, the developer is supplied from the developing roller 54 onto the electrostatic latent image on the photosensitive drum 52, and the developer image is formed on the photosensitive drum 52.

Then, when the sheet P passes through the image forming position, the developer image on the photosensitive drum 52 is transferred onto the sheet P. The sheet P then enters the fixing unit 60 and passes between the heating roller 61 and the pressing roller 62, so that the developer image is heated and fixed. The sheet P conveyed from the fixing unit 60 is guided by the discharge path 8 to change the conveyance direction thereof from rearward to forward, and is discharged to the outside of the body casing 2 by the normally rotating discharge roller 82. The discharged sheet P is stacked in the sheet discharging tray 22.

According to the first exemplary embodiment of the invention, following effects can be obtained.

Since the reverse feeding path 9 is joined with the feeding path 7 between the photosensitive drum 52 and the registration roller 38, it is not necessary to provide a space in which the reverse feeding path is provided forward of the registration roller 38 (that is, at the upstream side in the conveyance direction of sheet P). Therefore, the dimension of the body casing 2 in the front-rear direction can be made small, and the size of the image forming apparatus 1 can be reduced.

Further, an entire length of the reverse feeding path 9 can be shortened in comparison with a structure where the reverse feeding path is joined with the feeding path forward of the registration rollers. Therefore, the number of conveyance rollers can be decreased, and it is possible to suppress the costs and to simplify the structure of the image forming apparatus. Further, since the reverse feeding path 9 is shortened, it is possible to prevent the sheet P from being jammed in the reverse feeding path 9.

Since the joining position of the reverse feeding path 9 and the feeding path 7 (that is, the joining position X) is provided at the position where the feeding path 7 is opposed to the process cartridge 50, the dimension of the body casing 2 in the front-rear direction thereof can be further made small in comparison with a structure where the joining part is provided at the upstream side of the process cartridge in the conveyance direction.

Since the nipping position N that the registration rollers 38 nip sheets P is provided at the side, at which the photosensitive drum 52 is provided, from the extension face S in the conveyance direction of the sheet P on the image forming position, the dimension of the body casing 2 in the up-down direction thereof can be made smaller than in the structure in which the above-described positional relationship is reversed. In such a structure, since the dimension in the up-down direction can be made small, the curvature of the path where the reverse feeding path is joined with the feeding path is made larger. Therefore, there may be a case where the curvature of the sheet P when the conveyance direction thereof is reversed may be increased. Thus, it may become hard to convey the sheet P.

Generally, as shown in FIG. 3, in the process cartridge 50, the developer accommodating unit 57 has substantially a cylindrical shape because the agitator rotates along the inner surface of the developer accommodating unit 57, and the opening (with no reference numeral and letter given) through which the developer is supplied from the developer accommodating unit 57 is formed upward of the supply roller 55. Therefore, a space can be provided on the lower surface of the casing 51 between the developer accommodating unit 57 and the supply roller 55. Accordingly, the joining position (the joining part X) between the reverse feeding path 9 and the feeding path 7 is provided between the developer accommodating unit 57 and the supply roller 55. Therefore, it is possible to decrease the curvature of sheets P when the conveyance direction thereof is reversed by utilizing the space.

In particular, in the first exemplary embodiment, a guide face 51A that reverses the conveyance direction of the sheet P and again guides to the feeding path 7 by guiding the sheet P while bending the sheet P is provided in the space. Accordingly, the curvature of the sheet P can be made small when the conveyance direction thereof is reversed, and the sheet P can be smoothly guided to the feeding path 7. Therefore, it is possible to prevent the sheets P from being jammed in a vicinity of the reverse feeding path 9 and the joining part X.

The joining position (joining part X) of the reverse feeding path 9 and the feeding path 7 is provided at the upstream side in the conveyance direction of the sheet P in the feeding path 7 from the detection sensor 71. Thus, both of the leading end of the sheet P passed through the feed roller 35 and the registration rollers 38 and the leading end of the sheet P again guided by the feeding path 7 from the reverse feeding path 9 can be detected by one sensor. That is, the same detector sensor can be used in both cases where one image is formed on one side of sheet P and where another image is formed on another side of sheet P. Accordingly, the number of detector sensors can be reduced. Therefore, it is possible to reduce the costs, and it is possible to simplify the structure of the image forming apparatus.

The feeding path 7 reverses the conveyance direction of sheet P, which is sent out by the pickup roller 34, and guides the sheet P to the image forming position, and the registration rollers 38 and the pickup roller 34 are provided so as to overlap each other in the up-down direction. Therefore, the front-rear and up-down dimensions of the body casing 2 can be further made small. In such a structure, it becomes particularly effective to join the reverse feeding path 9 with the feeding path 7 between the photosensitive drum 52 and the registration rollers 38, because it is difficult to secure a space to provide a reverse feeding path forward of registration rollers 38 as in the related art image forming apparatus.

Modified Example of First Exemplary Embodiment

Figure 4:
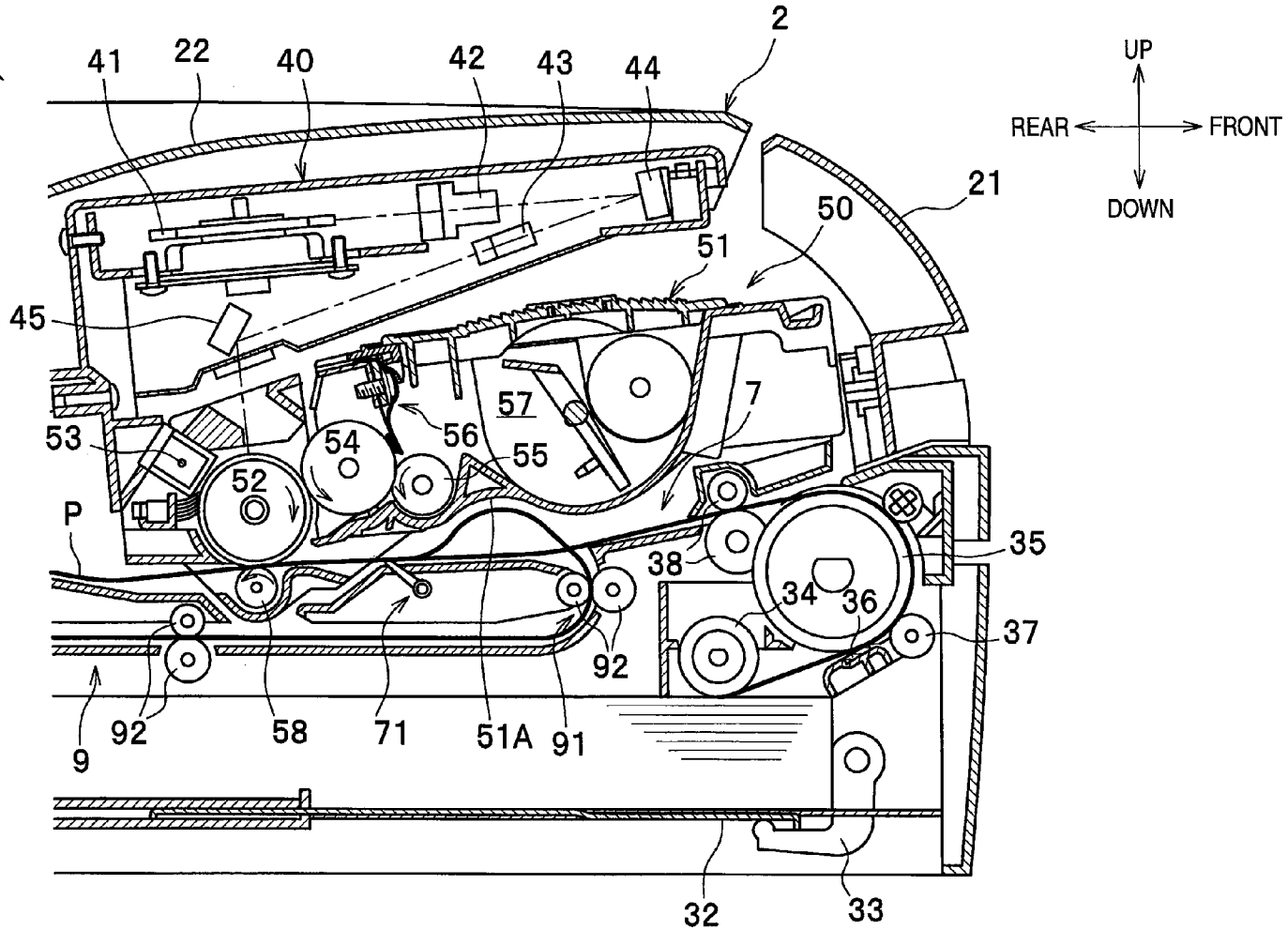
FIG. 4 is a partial enlarged view of the image forming apparatus according to a modified example of the first exemplary embodiment.

In the first exemplary embodiment, the conveyance rollers 92 are provided in the reverse feeding path 9 with interposing appropriate intervals therebetween. Incidentally, as shown in FIG. 4, the conveyance rollers 92 may also be provided at the curved portion 91. According thereto, the sheet P can be sent out from the reverse feeding path 9 to the feeding path 7 in a stabilized state by the conveyance rollers 92 secured at the curved portion 91.

Second Exemplary Embodiment

Figure 5:
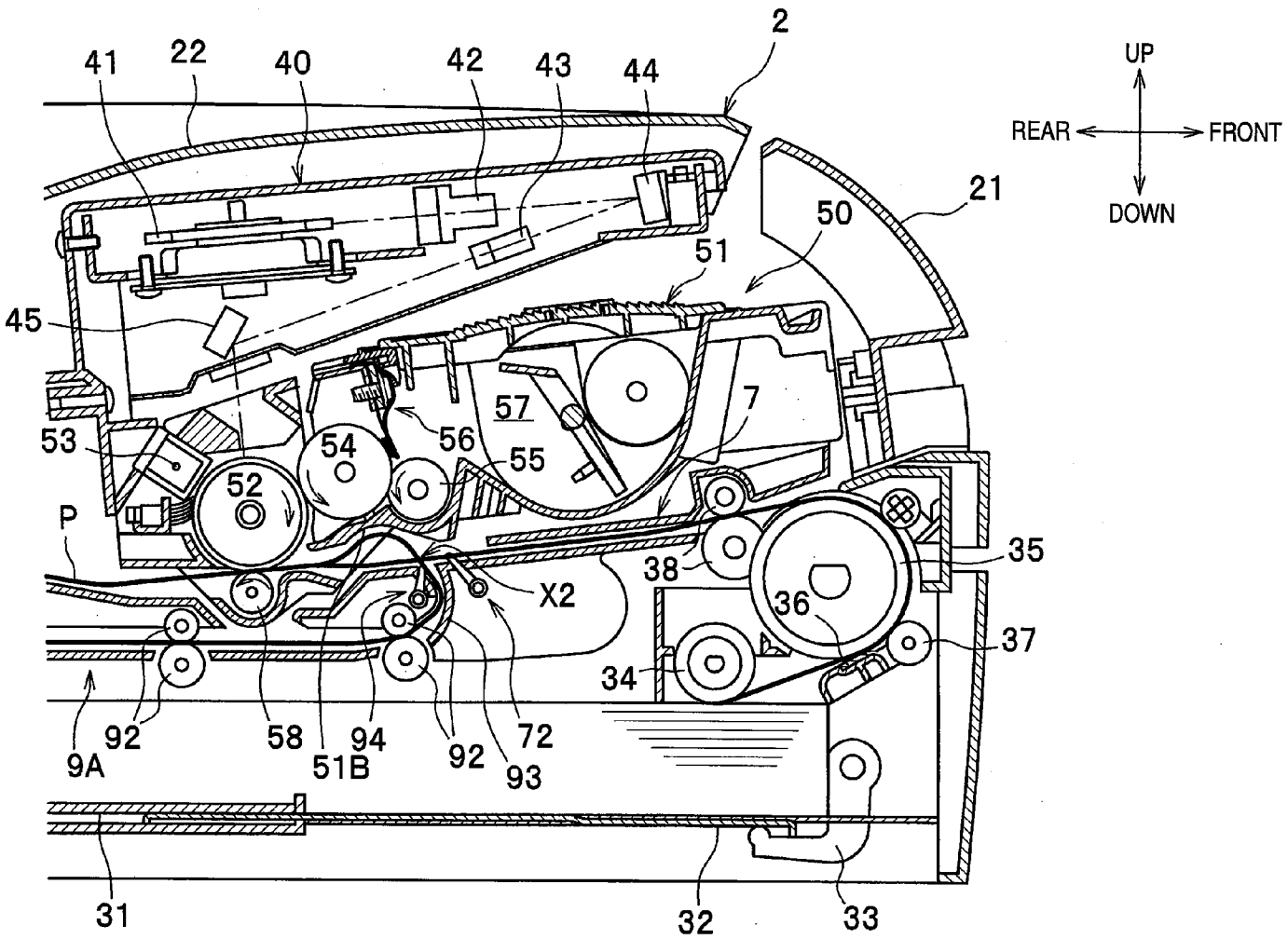
FIG. 5 is a partial enlarged view of the image forming apparatus according to a second exemplary embodiment of the invention.

Referring to FIG. 5, a second exemplary embodiment of the invention will be described. FIG. 5 is a partial enlarged view of the image forming apparatus according to the second exemplary embodiment. Incidentally, elements which are similar to those of the first exemplary embodiment are denoted by identical reference numerals, and a description thereof will be omitted.

(Feeding Path)

As shown in FIG. 5, the pickup roller 34, the feed roller 35, the feeding pad 36, the pinch roller 37, the registration rollers 38, and the first detection sensor 72 for detecting passage of sheets P are provided in the feeding path 7.

Similar to the detection sensor 71 according to the first exemplary embodiment, the first detection sensor 72 according to the second exemplary embodiment is provided between the photosensitive drum 52 and the registration rollers 38. That is, the first detection sensor 72 is provided between the supply roller 55 and the developer accommodating unit 57.

(Reverse Feeding Path)

The reverse feeding path 9A has substantially a U-shape extending downward, forward and upward in order from a vicinity of the guide wall 81 (refer to FIG. 1) of the discharge path 8. The reverse feeding path 9A passes through downward of the image forming position 4 and the curved portion 93, and is joined with the feeding path 7 at a joining part X2 (one example of a joining position with the feeding path 7). The reverse feeding path 9A includes a plurality of pairs of conveyance rollers 92 and the second detection sensor 94. The plurality of pairs of conveyance rollers 92 are provided with interposing appropriate intervals therebetween.

The curved portion 93 is formed downward of the joining part X2 of the reverse feeding path 9A. The curved portion 93 guides the sheet P guided by the reverse feeding path 9A while bending the sheet P as in the reverse feeding path 9 of the first exemplary embodiment. The curved portion 93 reverses the conveyance direction of the sheet P from forward to rearward diagonally upward and guides the sheet P to the feeding path 7.

The second detection sensor 94 for detecting a passage of the sheet P is provided in the curved portion 93. When the second detection sensor 94 detects the leading end of the sheet P conveyed in the reverse feeding path 9A during an image forming process, a control unit (not illustrated) controls light emission of the laser light emission unit of the exposure unit 40 and rotation drive of the polygon mirror 41 so as to control the irradiation timing of laser light from the exposure unit 40. That is, the second detection sensor 94 has a function of determining the timing of exposure (image formation) of the surface of the photosensitive drum 52.

The joining part X2 is provided between the photosensitive drum 52 and the registration rollers 38, and is provided at the downstream side in the conveyance direction of the sheet P in the feeding path 7 from the first detection sensor 72. That is, the joining part X2 is provided between the photosensitive drum 52 and the first detection sensor 72. In other words, the joining part X2 is provided at a position where the feeding path 7 is opposed to the process cartridge 50, and downward of the supply roller 55.

In the process cartridge 50 according to the second exemplary embodiment, a guide face 51B is provided on the lower surface of the casing 51 downward of the developing roller 54 and the supply roller 55. The guide face 51B has an arc shape in a side view. The sheet P guided in the reverse feeding path 9A and ejected from the curved portion 93 is bent along the guide face 51B. Therefore, the conveyance direction of the sheet P is reversed from rearward diagonally upward to rearward diagonally downward, and the sheet P is again guided into the feeding path 7 toward the rearward (i.e., toward the image forming position).

(Image Forming Process)

An image forming process of the image forming apparatus 1A (in a case where images are formed on both sides of sheet P) will be described (refer to FIG. 1).

When the image forming process is executed, the sheet P in the sheet feeding tray 31 is conveyed toward the image forming position. When the leading end of the sheet P is detected by the first detection sensor 72, laser light is irradiated from the exposure unit 40 toward to the photosensitive drum 52 to expose the surface of the photosensitive drum 52, and an electrostatic latent image is formed on the photosensitive drum 52. The developer is supplied from the developing roller 54 onto the electrostatic latent image on the photosensitive drum 52, and a developer image is formed on the photosensitive drum 52. Then, the developer image is transferred onto the sheet P by passage thereof through the image forming position, and the developer image is heated and fixed by the fixing unit 60.

The sheet P conveyed from the fixing unit 60 is guided from the discharge path 8 to the reverse feeding path 9A and is conveyed forward by the conveyance rollers 92. When the leading end of the sheet P that entered the curved portion 93 is detected by the second detection sensor 94, the laser light is irradiated from the exposure unit 40 to the photosensitive drum 52 to expose the surface of the photosensitive drum 52. Accordingly, an electrostatic latent image is formed on the photosensitive drum 52. The developer is supplied from the developing roller 54 onto the electrostatic latent image, and a developer image is formed on the photosensitive drum 52. Then, the developer image is transferred onto the sheet P by passage thereof through the image forming position, and the developer image is heated and fixed by the fixing unit 60. The sheet P conveyed from the fixing unit 60 is guided in the discharge path 8 and is stacked in the sheet discharging tray 22 by a normally rotating discharge roller 82.

According to the second exemplary embodiment, effects similar to those of the first exemplary embodiment can be obtained. In addition, according to the second exemplary embodiment, following effects can be further obtained.

In the second exemplary embodiment, the first detection sensor 72 is provided in the feeding path 7 between the photosensitive drum 52 and the registration rollers 38, the second detection sensor 94 is provided at the curved portion 93 of the reverse feeding path 9A, and the joining position of the reverse feeding path 9A and the feeding path 7 is provided further at the downstream side in the conveyance direction of sheet P in the feeding path 7 from the first detection sensor 72. Therefore, the entire length of the reverse feeding path 9A can be further shortened in addition to the first exemplary embodiment.

Modification to Exemplary Embodiments

While the present invention has been shown and described with reference to certain exemplary embodiments thereof, it will be understood by those skilled in the art that various changes in form and details may be made therein without departing from the spirit and scope of the invention as defined by the appended claims.

(First Modification)

Figure 6:
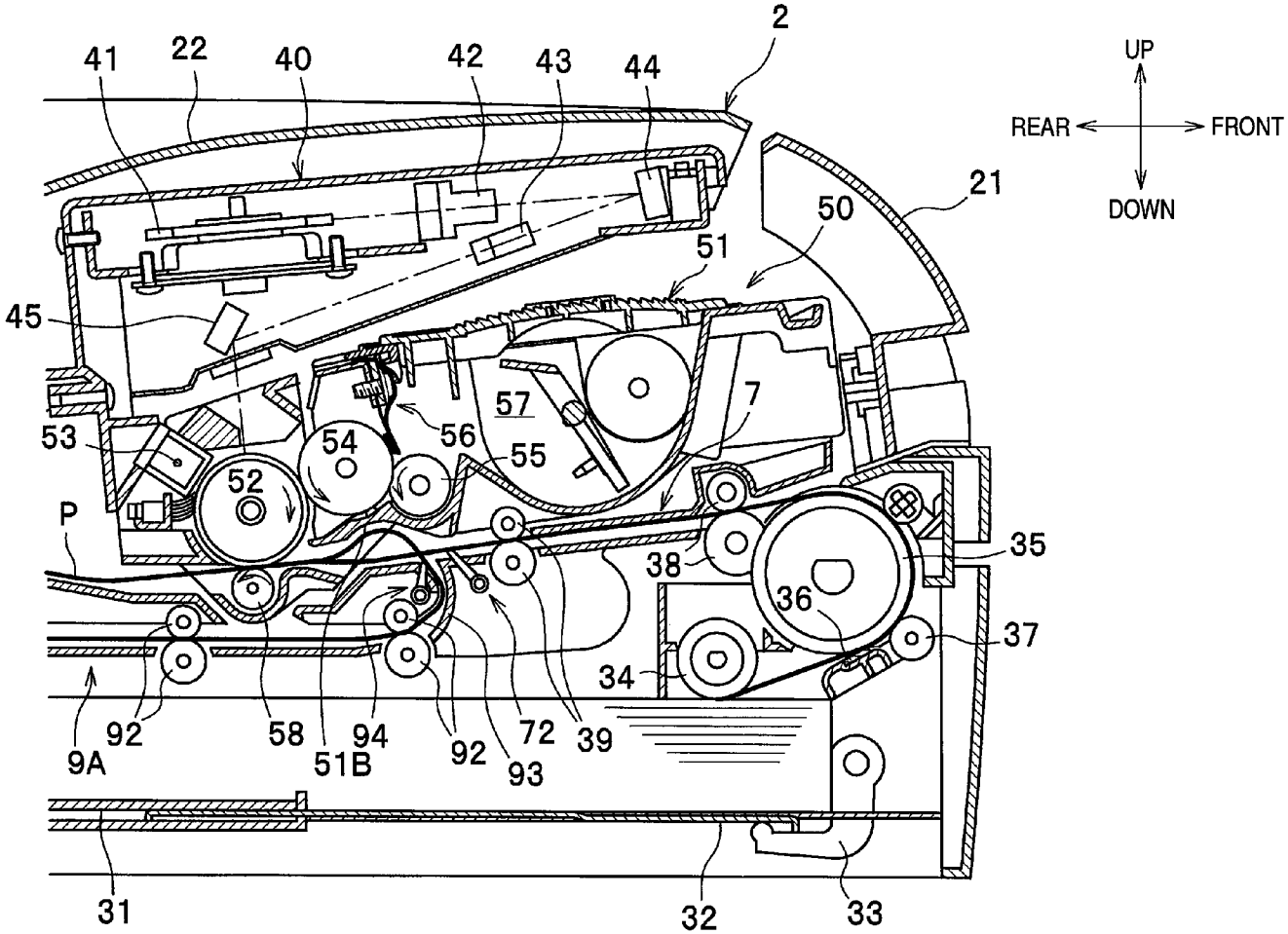
FIG. 6 is a partial enlarged view of the image forming apparatus according to a first modification to exemplary embodiments of the invention.

In the above-described exemplary embodiments, the reverse feeding path 9 or 9A is joined with the feeding path 7 between the photosensitive drum 52 and the registration roller 38 as an example of a conveyance roller. However, the invention is not limited thereto. For example, as shown in FIG. 6, a pair of conveyance rollers 39 (one example of a first conveyance roller) may be provided at the downstream side of the registration rollers 38 (one example of a second conveyance roller) in the conveyance direction of sheet P in the feeding path 7, and the reverse feeding path 9A may be joined with the feeding path 7 between the photosensitive drum 52 and the conveyance roller 39. That is, the reverse feeding path may be joined with the feeding path between the image carrier and the conveyance roller provided immediately before the image carrier.

(Second Modification)

Figure 7:
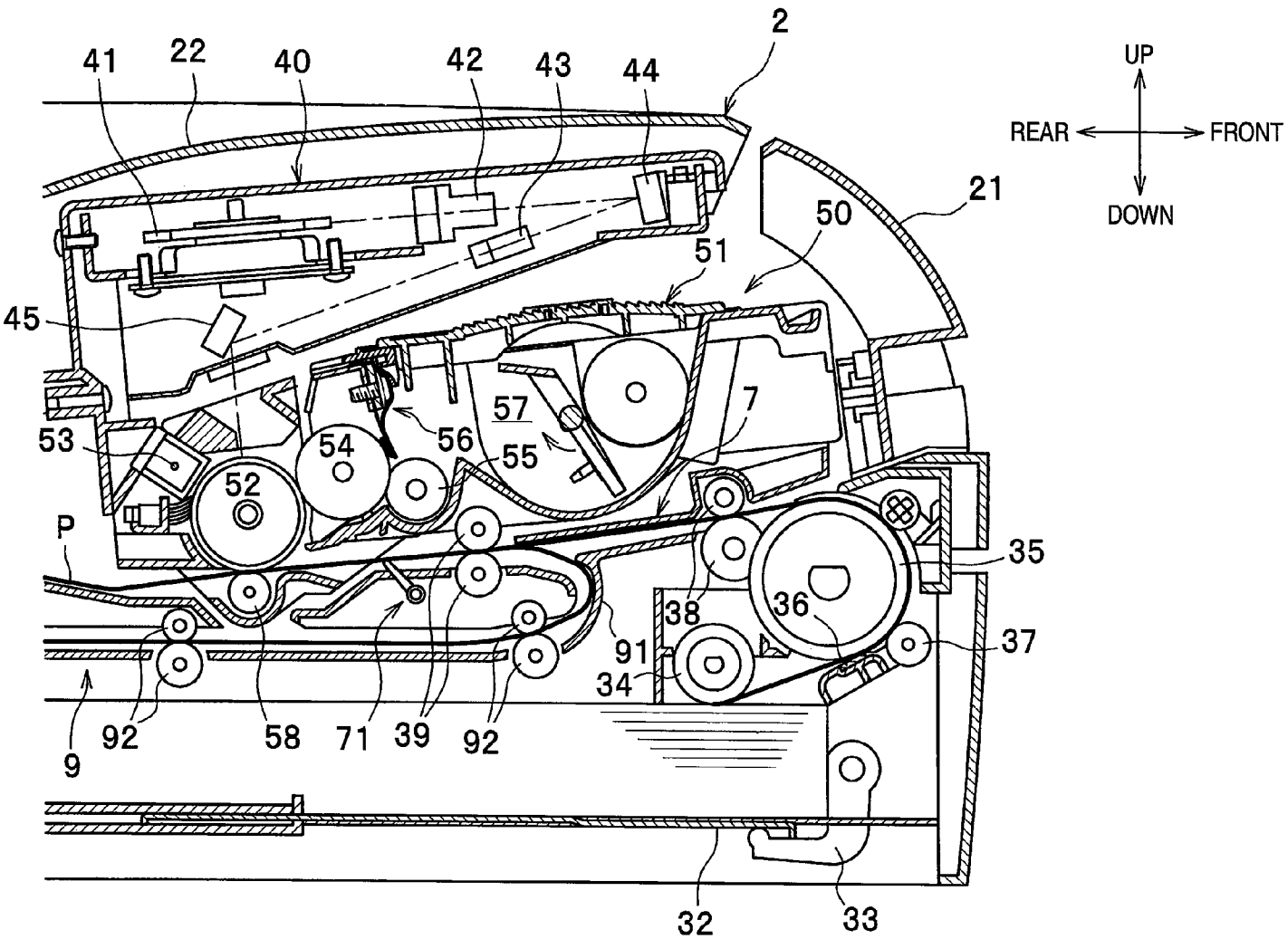
FIG. 7 is a partial enlarged view of the image forming apparatus according to second modification to exemplary embodiments of the invention.

Further, as shown in FIG. 7, a pair of conveyance rollers 39 may be provided at the downstream side of the registration rollers 38 in the conveyance direction of sheet P in the feeding path 7, and the reverse feeding path 9 may be joined with the feeding path 7 at the upstream side of the conveyance roller 39 in the conveyance direction of sheet P between the photosensitive drum 52 and the registration rollers 38.

(Other Modifications)

In the above-described exemplary embodiments, the process cartridge 50 including the photosensitive drum 52, the developing roller 54, the supply roller 55 and the developer accommodating unit 57, etc., is adopted in an integrally configured casing 51. However, the invention is not limited thereto. For example, the process cartridge may be configured so that it can be divided into a unit having a photosensitive drum and a unit having a developing roller, a supply roller and a developer accommodating unit. Further, the process cartridge may be divided into a unit having a photosensitive drum, a unit having a developing roller and a supply roller, and a unit having a developer accommodating unit (i.e., a so-called developer cartridge).

Incidentally, the invention may be configured so that a unit having a photosensitive drum is mounted in the apparatus main body, and a unit having a developing roller, a supply roller and a developer accommodating unit is removably mounted to the apparatus main body.

In the above-described exemplary embodiments, the photosensitive drum 52 is referred to as an example of an image carrier, the developing roller 54 is referred to as an example of an developer carrier, and the supply roller 55 is referred to as an example of a developer supply member, etc. However, the invention is not limited thereto. That is, the configuration etc., may be appropriately modified in a range not departing from the spirit of the invention.

In the above-described exemplary embodiments, the joining part (joining part X) of the reverse feeding path 9 and the feeding path 7 is provided at the position where the feeding path 7 is opposed to the process cartridge 50. However, the invention is not limited thereto. For example, the joining position of the reverse feeding path and the feeding path may be provided at the upstream side of the process cartridge in the conveyance direction of the recording sheet.

In the above-described exemplary embodiments, the nip position N of the registration rollers 38 nipping the sheet P is provided further at the side, at which the photosensitive drum 52 is provided, from the extension face S in the conveyance direction of the sheet P at the image forming position. However, the invention is not limited thereto. For example, the nip position of the conveyance roller (registration roller, etc.) may be arranged at the opposite side of the side, at which the image carrier is provided, from the extension face in the conveyance direction of the recording sheet at the image forming position.

In the above-described exemplary embodiments, three pairs of conveyance rollers are provided in the reverse feeding path 9 as shown in FIG. 1. However, the number of conveyance rollers and positions where the conveyance rollers are provided are not limited thereto. Further, the conveyance rollers may be provided in the discharge path.

In the above-described exemplary embodiments, a so-called S-pass type image forming apparatus 1, in which the conveyance direction of sheet P is reversed rearward after the sheet P is sent out forward from the sheet feeding tray 31, the sheet P passes rearward through the image forming position, the conveyance direction of the sheet P is reversed from rearward to forward, and the sheet P is discharged on the sheet discharging tray 22, have been described. However, the invention is not limited thereto. For example, it may be adopted an image forming apparatus having a pass type, in which, after a sheet is sent out rearward from the sheet feeding tray, the conveyance direction of the sheet is reversed forward, and the sheet is straightly discharged outside from the front side of the apparatus main body, passing forward through the image forming position, may be adopted. Further, it may be adopted a so-called C-pass type image forming apparatus, in which, after a sheet is sent out forward from the sheet feeding tray, it passes through the image forming position from downward to upward with the conveyance direction thereof changed upward, and is discharged to the outside of the apparatus main body, changing the conveyance direction from upward to rearward. That is, the shapes of the feeding path, discharge path and reverse feeding path of the invention may be modified.

Although exemplary embodiments of the present inventive concept have been described in relation to a laser printer, the present inventive concept is not limited to the laser printer. Rather, the present inventive concept can also be applied to a copier and a multi-function device.

What is claimed is:

1. An image forming apparatus that forms an image on both sides of a recording sheet, the image forming apparatus comprising:

an apparatus main body;

an image forming unit, which comprises a process cartridge which is configured to be removably mounted to the apparatus main body and which comprises an image carrier carrying a developer image, the image forming unit configured to form an image by transferring the developer image carried by the image carrier onto the recording sheet at an image forming position;

a recording sheet accommodating unit, which is provided downward of the image forming unit, and which accommodates the recording sheet;

a feeding path that guides the recording sheet conveyed from the recording sheet accommodating unit to the image forming position;

a conveyance roller, which is provided in the feeding path at a position upstream of the image carrier and without rollers therebetween, which regulates movement of a leading end of the recording sheet, and which conveys the recording sheet to the image forming position;

a discharge path that guides the recording sheet ejected from the image forming unit to outside of the apparatus main body;

a discharge roller, which is provided in the discharge path, which is rotatable normally and reversely, and which discharges the recording sheet to the outside of the apparatus main body when the discharge roller normally rotates; and a reverse feeding path, by which the recording sheet is guided when the discharge roller reversely rotates, and which reverses the recording sheet so as to guide the recording sheet to be joined again with the feeding path, wherein the reverse feeding path is joined with the feeding path at a joining position between the image carrier and the conveyance roller, wherein a bottom surface of the process cartridge forms a top of the feeding path from after the conveyance roller through the image forming position such that when the recording sheet returns to the feeding path from the reverse feeding path, the sheet abuts against and is guided by an arc-shaped guide face of the bottom surface of the process cartridge, and wherein the reverse feeding path is configured to feed the recording sheet, which is transmitted through the reverse feeding path, to the image forming position without any roller regulating the movement of the leading end of the recording sheet.

2. The image forming apparatus according to claim 1, wherein the reverse feeding path and the feeding path are joined at a joining position where the feeding path is opposed to the process cartridge when the process cartridge is mounted to the apparatus main body.

3. The image forming apparatus according to claim 2, wherein the conveyance roller nips the recording sheet at a nipping position, the nipping position being provided at a side close to the image carrier from an extension face that is extended in a conveyance direction of the recording sheet from the image forming position, wherein the process cartridge further comprises:

a developer carrier that supplies a developer to the image carrier;

a developer supplying member that supplies the developer to the developer carrier; and a developer accommodating unit that accommodates the developer, wherein, when the process cartridge is mounted to the apparatus main body, the developer accommodating unit, the developer supplying member, the developer carrier and the image carrier are provided in order from an upstream side to a downstream side in the conveyance direction of the recording sheet in the feeding path, and the joining position is provided between the developer accommodating unit and the developer supplying member.

4. The image forming apparatus according to claim 1, further comprising:

a detection sensor, which is provided in the feeding path between the image carrier and the conveyance roller, and which detects passage of the recording sheet, wherein the reverse feeding path and the feeding path are joined at a joining position that is provided at an upstream side in the conveyance direction of the recording sheet in the feeding path from the detection sensor.

5. The image forming apparatus according to claim 1, further comprising:

a first detection sensor, which is provided in the feeding path between the image carrier and the conveyance roller, and which detects passage of the recording sheet; and a second detection sensor, which is provided in the reverse feeding path, and which detects the passage of the recording sheet to determine a timing of image formation, wherein the reverse feeding path and the feeding path are joined at a joining position that is provided at a downstream side in the conveyance direction of the recording sheet in the feeding path from the first detection sensor.

6. The image forming apparatus according to claim 1, wherein the reverse feeding path comprises:

a curved portion that reverses the conveyance direction of the recording sheet by bending the recording sheet guided by the reverse feeding path so as to guide the recording sheet again in the sheet feeding path, and wherein the curved portion comprises a conveyance roller that conveys the recording sheet.

7. The image forming apparatus according to claim 1, further comprising:

a pickup roller that sends out the recording sheet from the recording sheet accommodating unit into the feeding path, wherein the feeding path guides the recording sheet to the image forming position by reversing the conveyance direction of the recording sheet sent out by the pickup roller, and wherein the conveyance roller and the pickup roller overlap each other in an up-down direction.

8. The image forming apparatus according to claim 7, further comprising:

a recording sheet discharge unit that is provided upward of the image forming unit, the recording sheet discharged to the outside of the apparatus main body being stacked on the recording sheet discharge unit, wherein the discharge path reverses the conveyance direction of the recording sheet so as to guide the recording sheet ejected from the image forming unit to the recording sheet discharge unit.

9. An image forming apparatus that forms an image on both sides of a recording sheet, the image forming apparatus comprising:

an apparatus main body;

an image forming unit, which comprises a process cartridge which is configured to be removably mounted to the apparatus main body and which comprises an image carrier carrying a developer image, the image forming unit configured to form an image by transferring the developer image carried by the image carrier onto the recording sheet at an image forming position;

a recording sheet accommodating unit, which is provided downward of the image forming unit, and which accommodates the recording sheet;

a feeding path that guides the recording sheet conveyed from the recording sheet accommodating unit to the image forming position;

a conveyance roller, which is provided in the feeding path at a position immediately before the image carrier, and which conveys the recording sheet to the image forming position;

a discharge path that guides the recording sheet ejected from the image forming unit to outside of the apparatus main body;

a discharge roller, which is provided in the discharge path, which is rotatable normally and reversely, and which discharges the recording sheet to the outside of the apparatus main body when the discharge roller normally rotates; and a reverse feeding path, by which the recording sheet is guided when the discharge roller reversely rotates, and which reverses the recording sheet so as to guide the recording sheet to be joined again with the feeding path, wherein the reverse feeding path is joined with the feeding path at a joining position between the conveyance roller and the image carrier, wherein the conveyance roller comprises:

a first conveyance roller that is adjacent to the image carrier at an upstream side in a conveyance direction of the recording sheet; and a second conveyance roller, configured to correct a skew of the recording sheet, and which is provided at the upstream side in the conveyance direction of the recording sheet, and which regulates movement of a leading end of the recording sheet, wherein the reverse feeding path is joined with the feeding path between the first conveyance roller and the image carrier, wherein a bottom surface of the process cartridge forms a top of the feeding path from after the conveyance roller through the image forming position such that when the recording sheet returns to the feeding path from the reverse feeding path, the sheet abuts against and is guided by an arc-shaped guide face of the bottom surface of the process cartridge, and wherein the reverse feeding path is configured to feed the recording sheet, which is transmitted through the reverse feeding path, to the image forming position without any roller regulating the movement of the leading end of the recording sheet.

10. The image forming apparatus according to claim 9, wherein the conveyance roller is adjacent to the image carrier at an upstream side in a conveyance direction of the recording sheet.

11. The image forming apparatus according to claim 9, wherein the reverse feeding path and the feeding path are joined at a joining position where the feeding path is opposed to the process cartridge.

12. The image forming apparatus according to claim 11, wherein the conveyance roller nips the recording sheet at a nipping position, the nipping position being provided at a side close to the image carrier from an extension face that is extended in a conveyance direction of the recording sheet from the image forming position, wherein the process cartridge further comprises:

a developer carrier that supplies a developer to the image carrier;

a developer supplying member that supplies the developer to the developer carrier; and a developer accommodating unit that accommodates the developer, wherein, when the process cartridge is mounted to the apparatus main body, the developer accommodating unit, the developer supplying member, the developer carrier and the image carrier are provided in order from an upstream side to a downstream side in the conveyance direction of the recording sheet in the feeding path, and the joining position is provided between the developer accommodating unit and the developer supplying member.

13. The image forming apparatus according to claim 9, further comprising:

a detection sensor, which is provided in the feeding path between the image carrier and the conveyance roller, and which detects passage of the recording sheet, wherein the reverse feeding path and the feeding path are joined at a joining position that is provided at an upstream side in the conveyance direction of the recording sheet in the feeding path from the detection sensor.

14. The image forming apparatus according to claim 9, further comprising:

a first detection sensor, which is provided in the feeding path between the image carrier and the conveyance roller, and which detects passage of the recording sheet; and a second detection sensor, which is provided in the reverse feeding path, and which detects the passage of the recording sheet to determine a timing of image formation, wherein the reverse feeding path and the feeding path are joined at a joining position that is provided at a downstream side in the conveyance direction of the recording sheet in the feeding path from the first detection sensor.

15. The image forming apparatus according to claim 9, wherein the reverse feeding path comprises:

a curved portion that reverses the conveyance direction of the recording sheet by bending the recording sheet guided by the reverse feeding path so as to guide the recording sheet again in the sheet feeding path, and wherein the curved portion comprises a conveyance roller that conveys the recording sheet.

16. The image forming apparatus according to claim 9, further comprising:

a pickup roller that sends out the recording sheet from the recording sheet accommodating unit into the feeding path, wherein the feeding path guides the recording sheet to the image forming position by reversing the conveyance direction of the recording sheet sent out by the pickup roller, and wherein the conveyance roller and the pickup roller overlap each other in an up-down direction.

17. The image forming apparatus according to claim 16, further comprising:

a recording sheet discharge unit that is provided upward of the image forming unit, the recording sheet discharged to the outside of the apparatus main body being stacked on the recording sheet discharge unit, wherein the discharge path reverses the conveyance direction of the recording sheet so as to guide the recording sheet ejected from the image forming unit to the recording sheet discharge unit.

18. An image forming apparatus that forms an image on both sides of a recording sheet, the image forming apparatus comprising:

an apparatus main body;

an image forming unit, which forms an image onto the recording sheet at an image forming position and which comprises a process cartridge which is configured to be removably mounted to the apparatus main body;

a recording sheet accommodating unit, which is provided downward of the image forming unit, and which accommodates the recording sheet;

a feeding path that guides the recording sheet conveyed from the recording sheet accommodating unit to the image forming position;

a conveyance roller, which is provided in the feeding path at a position upstream of the image forming position and without rollers therebetween, which regulates movement of a leading end of the recording sheet, and which conveys the recording sheet to the image forming position;

a discharge path that guides the recording sheet ejected from the image forming unit to outside of the apparatus main body;

a discharge roller, which is provided in the discharge path, which is rotatable normally and reversely, and which discharges the recording sheet to the outside of the apparatus main body when the discharge roller normally rotates;

a reverse feeding path, by which the recording sheet is guided when the discharge roller reversely rotates, and which reverses the recording sheet so as to guide the recording sheet to be joined again with the feeding path, wherein the reverse feeding path is joined with the feeding path at a joining position between the image forming position and the conveyance roller, wherein a bottom surface of the process cartridge forms a top of the feeding path from after the conveyance roller through the image forming position such that when the recording sheet returns to the feeding path from the reverse feeding path, the sheet abuts against and is guided by an arc-shaped guide face of the bottom surface of the process cartridge, and wherein the reverse feeding path is configured to feed the recording sheet, which is transmitted through the reverse feeding path, to the image forming position without any roller regulating the movement of the leading end of the recording sheet.

* * * * *